US007975575B2

(12) United States Patent
Hu

(10) Patent No.: US 7,975,575 B2
(45) Date of Patent: Jul. 12, 2011

(54) POSITIONING DEVICE FOR ROTARY WRENCH

(76) Inventor: Bobby Hu, Taichung (TW)

( * ) Notice: Subject to any disclaimer, the term of this patent is extended or adjusted under 35 U.S.C. 154(b) by 224 days.

(21) Appl. No.: 12/464,926

(22) Filed: May 13, 2009

(65) Prior Publication Data

US 2010/0031782 A1 Feb. 11, 2010

(30) Foreign Application Priority Data

Aug. 8, 2008 (TW) ..... 97130422 A

(51) Int. Cl.
*B25B 23/16* (2006.01)
*B25B 13/00* (2006.01)
*B25G 1/00* (2006.01)

(52) U.S. Cl. ..... 81/177.8; 81/177.7

(58) Field of Classification Search ..... 81/177.7, 81/177.8, 177.9

See application file for complete search history.

(56) References Cited

U.S. PATENT DOCUMENTS 648,572 A * 5/1900 Patterson ..... 81/61
820,292 A * 5/1906 Dunbar ..... 403/4
1,331,956 A * 2/1920 Cross ..... 81/60
2,608,894 A * 9/1952 Miller, Jr. et al. ..... 81/177.9
2,977,824 A * 4/1961 Rueb ..... 76/114
7,246,544 B1 7/2007 Lee ..... 81/177.8
2006/0201288 A1* 9/2006 Chen ..... 81/177.8
2007/0163402 A1* 7/2007 Hsieh ..... 81/177.9

* cited by examiner

*Primary Examiner* — David B Thomas

(74) *Attorney, Agent, or Firm* — Alan Kamrath; Kamrath & Associates PA

(57) ABSTRACT

A rotary wrench includes a handle having a clamping portion with two arms. Each arm includes a holding portion having a hole. At least one of the holding portions includes a positioning section. Two axles are respectively formed on two sides of a head and rotatably engaged in the holes. At least one of the sides of the head includes a positioning portion releasably engagable with the positioning section so that the head is rotatable relative to the handle about an axis and positionable relative to the axis in one of a plurality of angular positions surrounding the axis. An adjusting member is mounted to the arms and operable to adjust the spacing between the arms to move the arms between a clamping position clamping the head and a releasing position not clamping the head.

19 Claims, 15 Drawing Sheets

POSITIONING DEVICE FOR ROTARY WRENCH

BACKGROUND OF THE INVENTION

The present invention relates to a positioning device for a rotary wrench and, more particularly, to a positioning device for a rotary wrench to position a head of the rotary wrench in a desired angular position relative to a handle of the rotary wrench.

A typical rotary wrench includes a handle and a head rotatably coupled to the handle. The handle includes first and second arms having a slit formed therebetween. The first arm has a first screw hole, and the second arm has a second screw hole. The first and second screw holes have different spiral directions and are opposite to each other. The head is disposed in a holding space between the first and second arms and includes two studs formed on opposite sides of the head. The studs couple with the first and second screw holes. When the head is rotated in a direction relative to the handle, the first and second arms move toward each other to tightly clamp the head. On the other hand, when the head is rotated in a reverse direction relative to the handle, the first and second arms move away from each other to loosen the head. An example of such a rotary wrench is disclosed in U.S. Pat. No. 7,246,544. However, the positioning effect of the rotary wrench by threading coupling between the studs and the screw holes is not reliable.

Thus, a need exists for a positioning device for a rotary wrench to reliably position the head relative to the handle.

BRIEF SUMMARY OF THE INVENTION

The present invention solves this need and other problems in the field of reliable positioning by providing, in a preferred form, a rotary wrench including a handle having a gripping portion and a clamping portion arranged along a first axis. The clamping portion includes first and second arms having a spacing along a second axis perpendicular to the first axis. The first arm includes a first holding portion having a first hole. The second arm includes a second holding portion having a second hole. The first holding portion includes a first positioning section. A head includes a longitudinal axis perpendicular to the second axis. The head includes first and second sides spaced along the second axis and on opposite sides of the longitudinal axis. First and second axles are respectively formed on the first and second sides. The first and second axles are rotatably engaged in the first and second holes. The first side of the head includes a first positioning portion releasably engagable with the first positioning section of the first holding portion so that the head is rotatable relative to the handle about the second axis and positionable relative to the second axis in one of a plurality of angular positions surrounding the second axis. The handle is operable to rotate the head about the longitudinal axis for driving an object. An adjusting member is mounted to the first and second arms. The adjusting member is operable to adjust the spacing between the first and second arms to move the first and second arms between a clamping position clamping the head and a releasing position not clamping the head.

When the first and second arms are in the releasing position, the first positioning portion of the head is disengaged from the first positioning section of the first holding portion so that the head is rotatable about the second axis, allowing adjustment of an angle between the longitudinal axis of the head and the first axis.

When the first and second arms are in the clamping position, the first positioning portion of the head is engaged with the first positioning section of the first holding portion to retain the head in one of the plurality of angular positions so that the head is not rotatable about the second axis, not allowing adjustment of the angle between the longitudinal axis of the head and the first axis.

In preferred forms, the second holding portion includes a second positioning section spaced from the first positioning section along the second axis. The second side of the head includes a second positioning portion spaced from the first positioning portion along the second axis. When the first and second arms are in the releasing position, the second positioning portion of the head is disengaged from the second positioning section of the second holding portion so that the head is rotatable about the second axis, allowing adjustment of the angle between the longitudinal axis of the head and the first axis. When the first and second arms are in the clamping position, the second positioning portion of the head is engaged with the second positioning section of the second holding portion to retain the head in one of the plurality of angular positions so that the head is not rotatable about the second axis, not allowing adjustment of the angle between the longitudinal axis of the head and the first axis.

In preferred forms, the first arm includes a third hole extending along a third axis parallel to and spaced from the second axis along the first axis. The third axis has a spacing to the gripping portion smaller than a spacing from the second axis to the gripping portion along the first axis. The second arm includes a fourth hole in the preferred form of a screw hole. The adjusting member includes a threaded section, a head portion, and an intermediate portion intermediate the head portion and the threaded section. The adjusting member extends through the third and fourth holes with the threaded section engaged with the screw hole and with the head portion received in the third hole. An adjusting wheel is coupled to the intermediate portion of the adjusting member. The adjusting member can be rotated about the third axis by rotating the adjusting member or engaging a tool with a groove in the head portion and rotating the tool, moving the first and second arms between the releasing position and the clamping position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
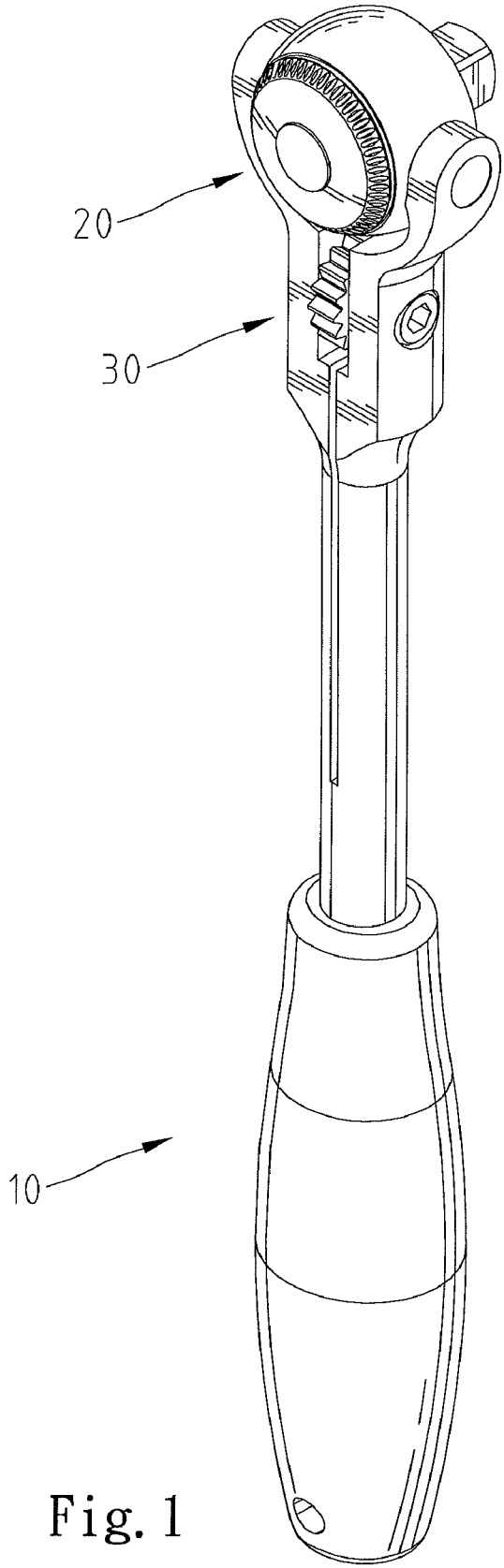
FIG. 1 shows a perspective view of a rotary wrench of an embodiment according to the preferred teachings of the present invention.
Figure 2:
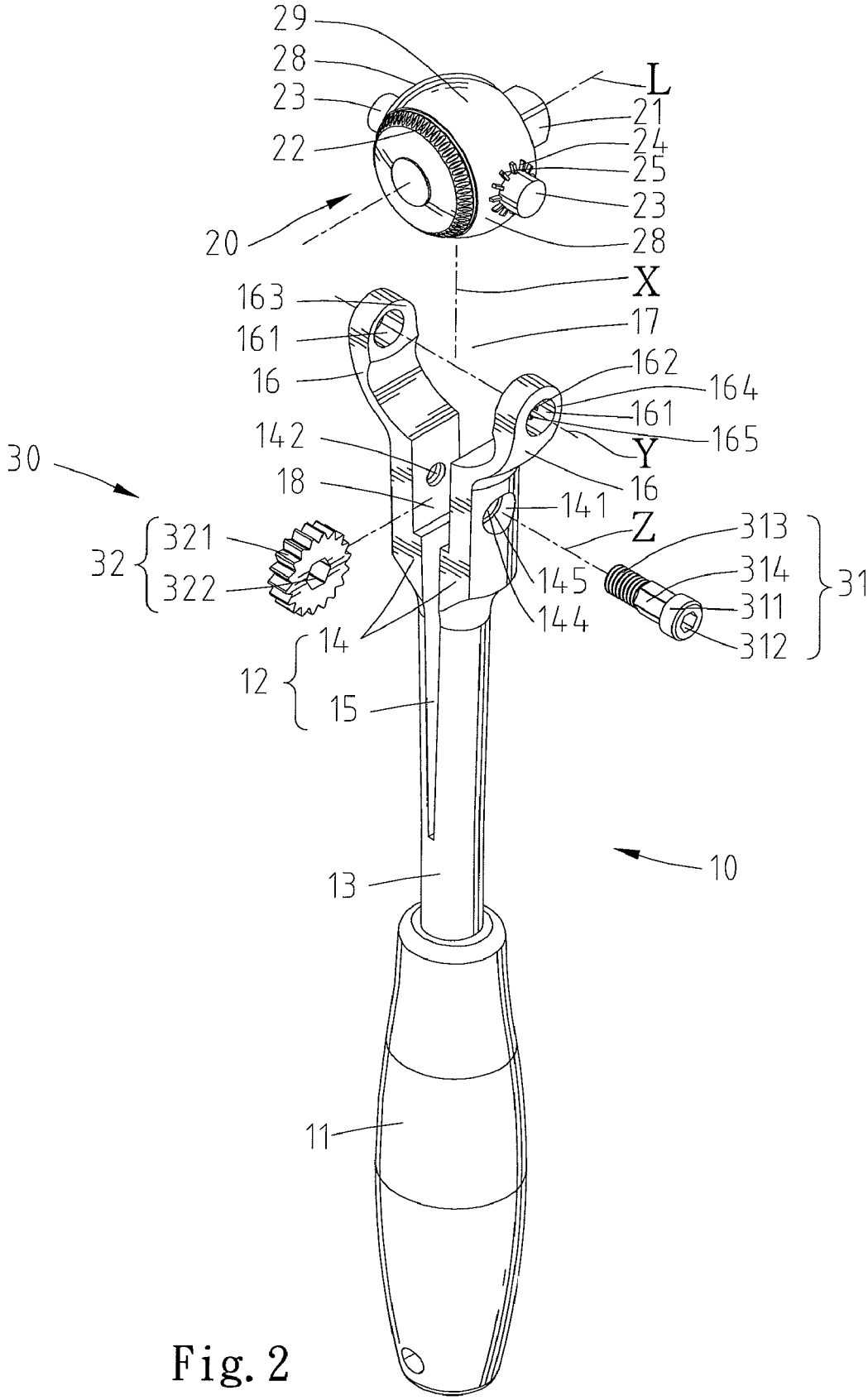
FIG. 2 shows an exploded, perspective view of the rotary wrench of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "inner", "outer", "side", "end", "portion", "section", "longitudinal", "radial", "circumferential", "annular", "spacing", "width", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A rotary wrench according to the preferred teachings of the present invention is shown in the drawings and generally includes a handle 10 and a head 20. In preferred forms shown in FIGS. 1-15, handle 10 includes a gripping portion 11 and a clamping portion 12 arranged along a first axis X. The clamping portion 12 includes an end 13 interconnected to gripping portion 11. The other end of clamping portion 12 includes first and second arms 14 having a spacing along a second axis Y perpendicular to first axis X. The spacing between first and second arms 14 defines a holding space 17 for rotatably receiving head 20. Each of first and second arms 14 includes a holding portion 16 having a hole 161. Each holding portion 16 includes inner and outer faces 163 and 164 spaced along second axis Y.

In the preferred forms shown in FIGS. 9-15, holding portion 16 of each of first and second arms 14 includes a positioning section 162 formed on inner face 163 thereof. In the preferred form shown in FIGS. 9-11, each positioning section 162 includes a plurality of grooves 165 spaced from one another in a circumferential direction about second axis Y. Each groove 165 is in communication with hole 161 of one of first and second arms 14. Furthermore, each groove 165 extends from inner face 163 towards but spaced from outer face 164. In the preferred form shown in FIG. 12, each groove 165 extends towards from but spaced from hole 161 in a radial direction orthogonal to second axis Y.

Figure 13:
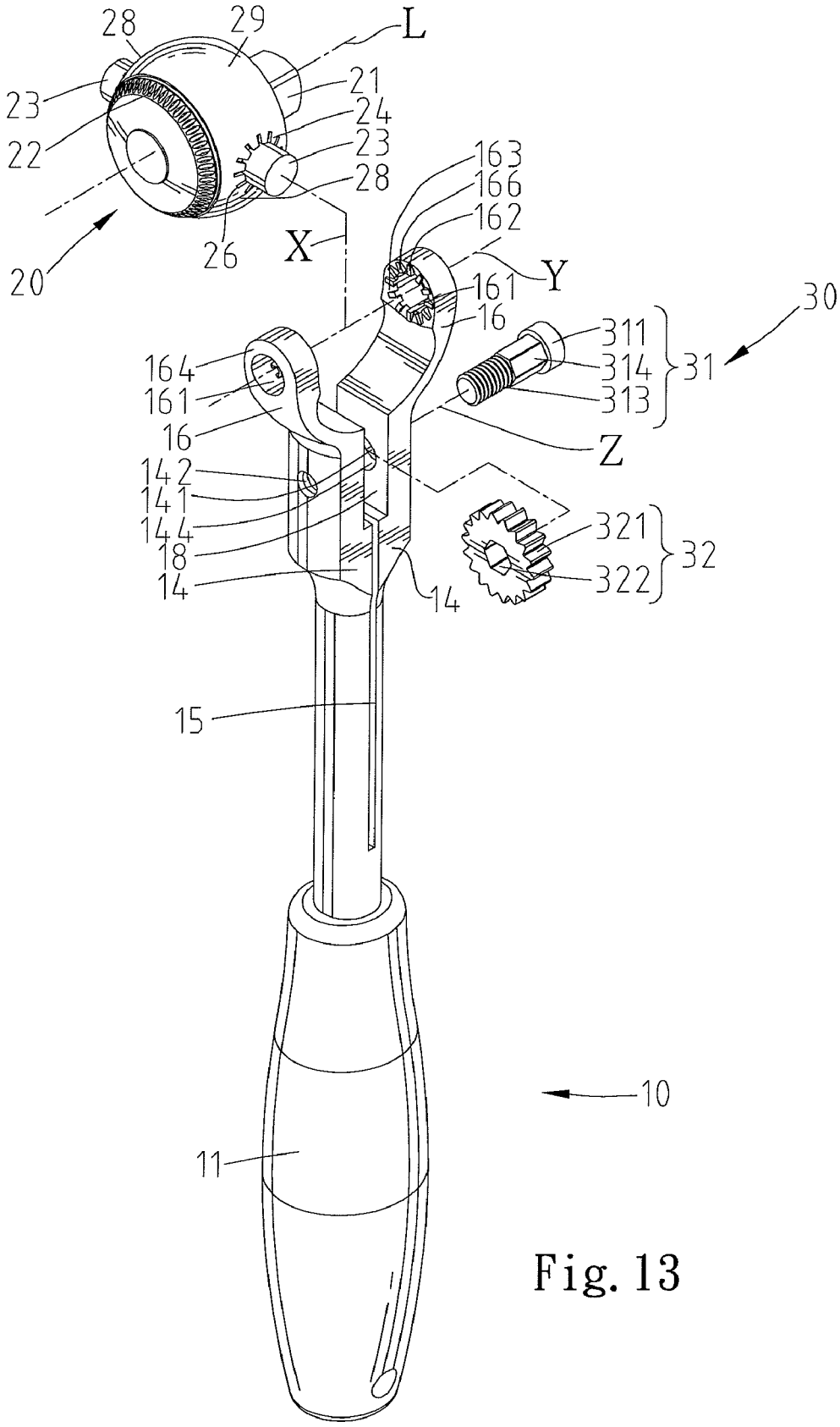
FIG. 13 shows an exploded, perspective view of a rotary wrench of yet another embodiment according to the preferred teachings of the present invention.
Figure 14:
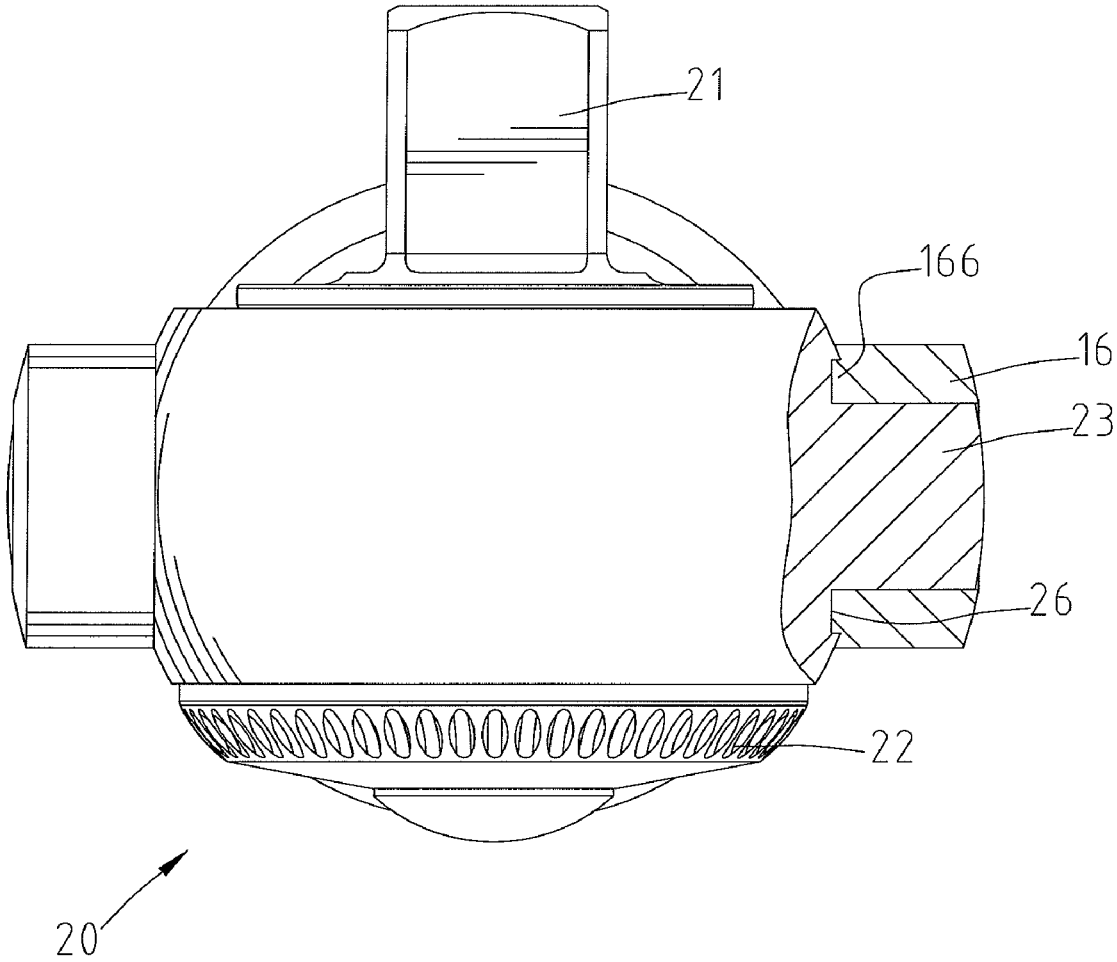
FIG. 14 shows a top view of the rotary wrench of FIG. 13 with a portion of the rotary wrench sectioned to show coupling between the head and an arm of the handle.

In the preferred form shown in FIGS. 13 and 14, each positioning section 162 includes a plurality of ribs 166 formed on inner face 163 of one of holding portions 16 and spaced from one another in the circumferential direction about second axis Y. In the preferred form shown in FIG. 15, each positioning section 162 includes a plurality of teeth 167 formed on inner face 163 of one of holding portions 16 and spaced from one another in the circumferential direction about second axis Y.

In the preferred form shown in FIGS. 1-8, only holding portion 16 of first arm 14 includes positioning section 162.

In the preferred forms shown in FIGS. 1-15, first arm 14 includes a hole 141 extending along a third axis Z parallel to and spaced from second axis Y along first axis X. Third axis Z has a spacing to gripping portion 11 smaller than second axis Y along first axis X. Hole 141 includes a reduced section 144 having a diameter smaller than a remaining portion of diameter of hole 141, forming a shoulder 145. Second arm 14 includes a hole 142 shown in the preferred form as a screw hole extending along third axis Z. Furthermore, a compartment 18 is formed between first and second aims 14 and intermediate holes 141 and 142 along third axis Z. Further, a slit 15 is formed between the first and second arms 14 adjacent end 13. Slit 15 is substantially V-shaped and has decreasing widths toward gripping portion 11 along first axis X. Slit 15 is intermediate third axis Z and gripping portion 11 along first axis X. Compartment 18 is in communication with holding space 17 and slit 15. Further, compartment 18 is intermediate holding space 17 and slit 15 along first axis X.

In the preferred forms shown in FIGS. 1-15, head 20 has a longitudinal axis L perpendicular to second axis Y. Head 20 includes an outer periphery 29 having first and second sides 28 spaced along second axis Y and on opposite sides of longitudinal axis L. First and second axles 23 are respectively formed on first and second sides 28. First and second axles 23 are rotatably engaged in holes 161 of first and second arms 14. Each of first and second sides 28 of head 20 includes first positioning portion 24 releasably engagable with positioning section 162 of one of first and second holding portions 16 so that head 20 is rotatable relative to handle 10 about second axis Y and positionable relative to second axis Y in one of a plurality of angular positions surrounding second axis Y. Handle 10 is operable to rotate head 20 about longitudinal axis L for driving an object.

In the preferred form shown in FIGS. 9-15, each of first and second sides 28 of head 20 includes a positioning portion 24. In the preferred form shown in FIGS. 9-11, each positioning portion 24 includes a plurality of ribs 25 formed on first side 28 of head 20 and spaced from one another in the circumferential direction about one of first and second axles 23. Each rib 25 extends from outer periphery 29 of head 20 to an outer periphery of one of first and second axles 23. In the preferred form shown in FIG. 12, each positioning portion 24 includes a plurality of ribs 25 formed on first side 28 of head 20 and spaced from one another in the circumferential direction about one of first and second axles 23. Each rib 25 is spaced from the outer periphery of one of first and second axles 23 in the radial direction. In the preferred form shown in FIGS. 13-14, each positioning portion 24 includes a plurality of grooves 26 formed in one of first and second sides 28 and spaced from one another in the circumferential direction about one of first and second axles 23. In the preferred form shown in FIG. 15, each positioning portion 24 includes a plurality of teeth 27 formed on one of first and second sides 28 and spaced from one another in the circumferential direction about one of first and second axles 23. In the preferred form shown in FIGS. 1-8, only first side 28 of head 20 includes positioning portion 24.

In the preferred form shown in FIGS. 1-15, head 20 further includes a drive section 21 for releasably coupling with a socket or the like for driving an object such as a nut, bolt, etc. Head 20 further includes a switch 22 for changing a driving direction of drive section 21. In the preferred form shown in FIGS. 1-10 and 13-15, switch 22 is in the form of a pivotable ring. In the preferred form shown in FIG. 11, switch 22 is in the form of a pivotable lever. Other forms and types of switch 22 and drive section 21 would be within the skill of the art.

In the preferred forms shown in FIGS. 1-15, an adjusting device 30 is provided for adjusting the spacing between first and second arms 14 to move first and second arms 14 between a clamping position clamping head 20 and a releasing position not clamping head 20. Adjusting device 30 includes an adjusting member 31 having a threaded section 313, a head portion 311, and an intermediate portion 314 intermediate head portion 311 and threaded section 313. Adjusting member 31 extends through holes 141 and 142 of first and second arms 14. Threaded section 313 is threadedly engaged with hole 142, and head portion 311 is received in hole 141. A groove 312 is defined in head portion 311. Intermediate portion 314 has non-circular cross sections shown in the preferred forms as hexagonal cross sections. An adjusting wheel 32 is securely mounted around intermediate portion 314 to rotate therewith about third axis Z. Adjusting wheel 32 is rotatably received in compartment 18 and includes a through-hole 322 having non-circular cross sections corresponding to intermediate portion 314. Intermediate portion 314 extends through through-hole 322. Adjusting wheel 32 includes an outer periphery 321 that can be manually rotated to rotate adjusting member 31 about third axis Z. Thus, adjusting member 31 can be rotated to move first and second arms 14 towards or away from each other by rotating adjusting wheel 32 or by engaging a tool with groove 312 and rotating the tool. Slit 15 allows easy movement between first and second arms 14 during adjustment of the spacing between first and second arms 14.

Figure 3:
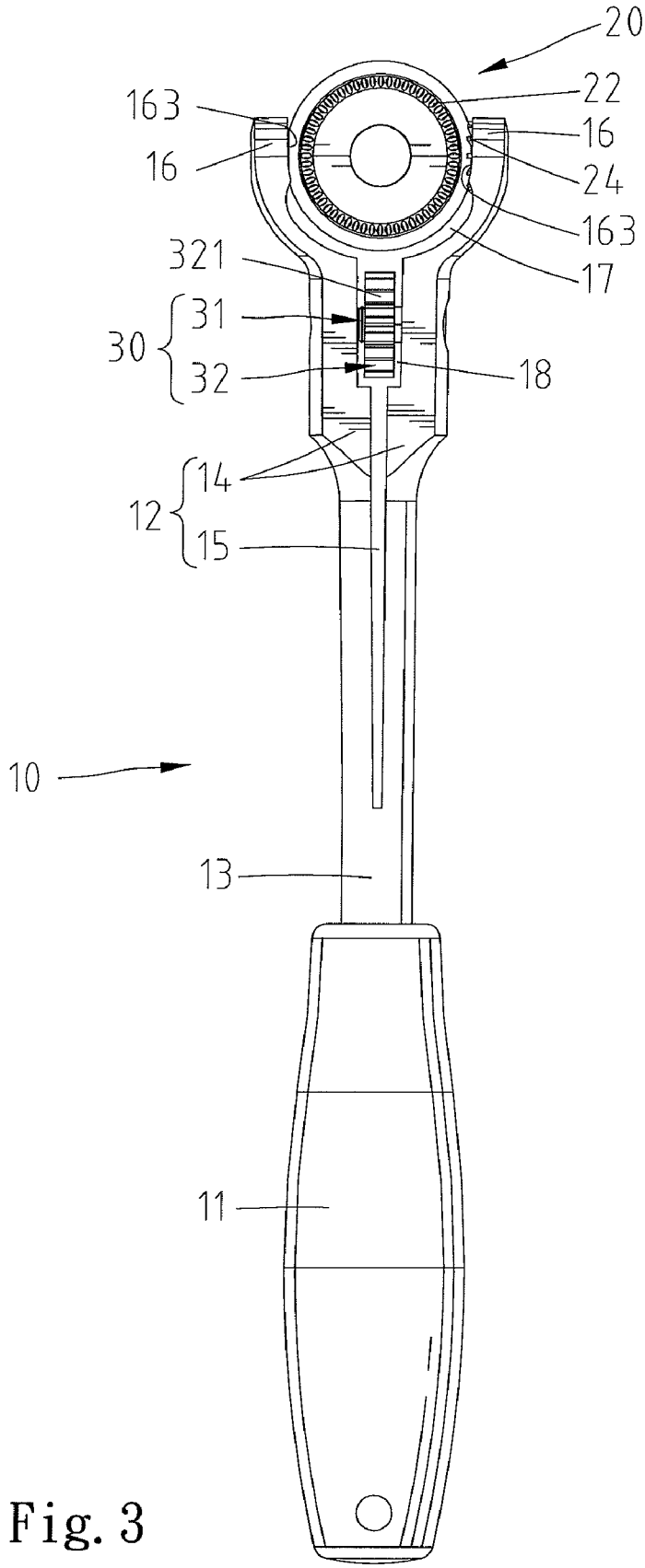
FIG. 3 shows a side view of the rotary wrench of FIG. 1 with two arms of a handle of the rotary wrench in a position disengaged with a head of the rotary wrench allowing relative rotation between the handle and the head.
Figure 4:
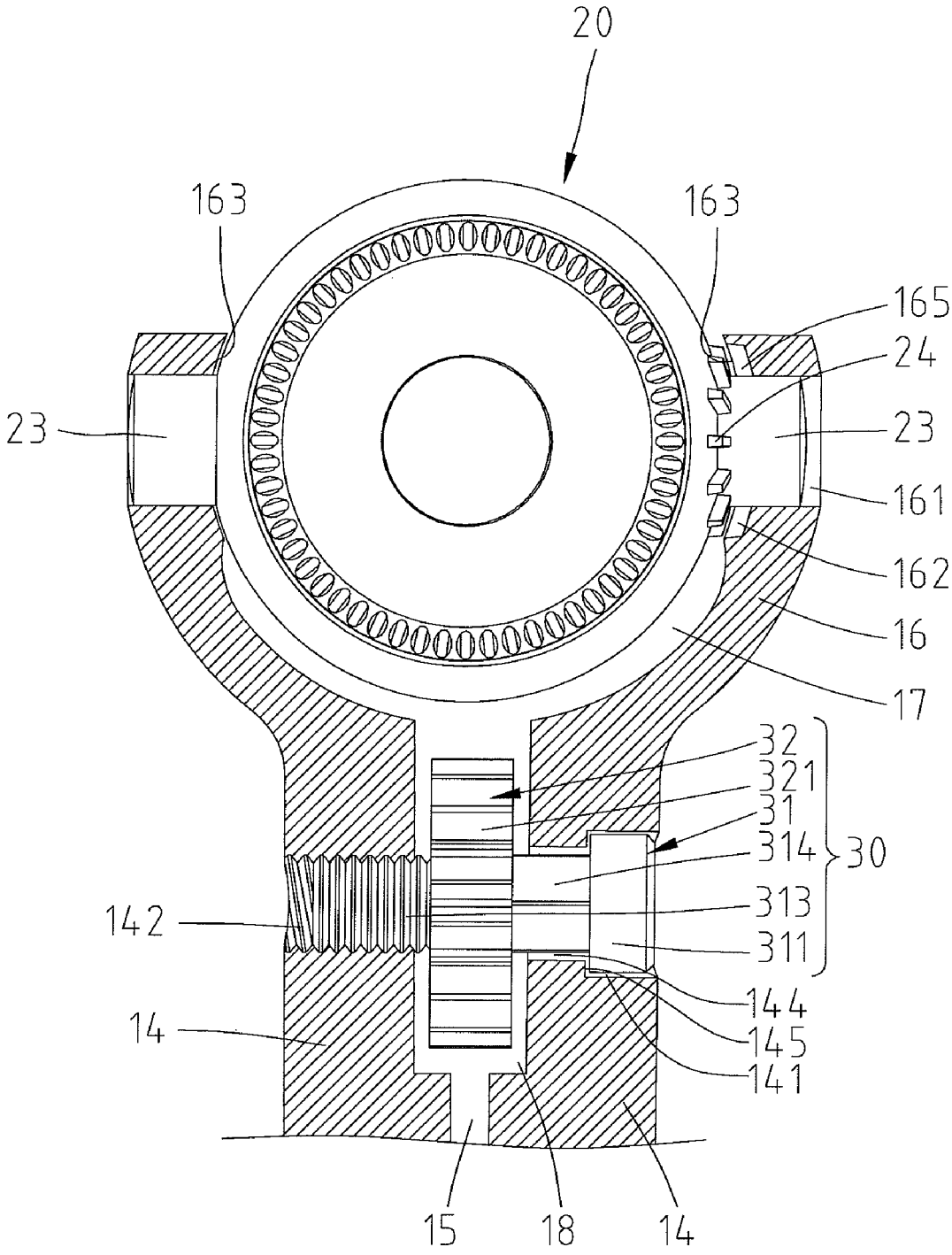
FIG. 4 shows a partial, cross sectional view of the rotary wrench of FIG. 1 with the arms of the handle in the position disengaged with the head allowing relative rotation between the handle and the head.
Figure 5:
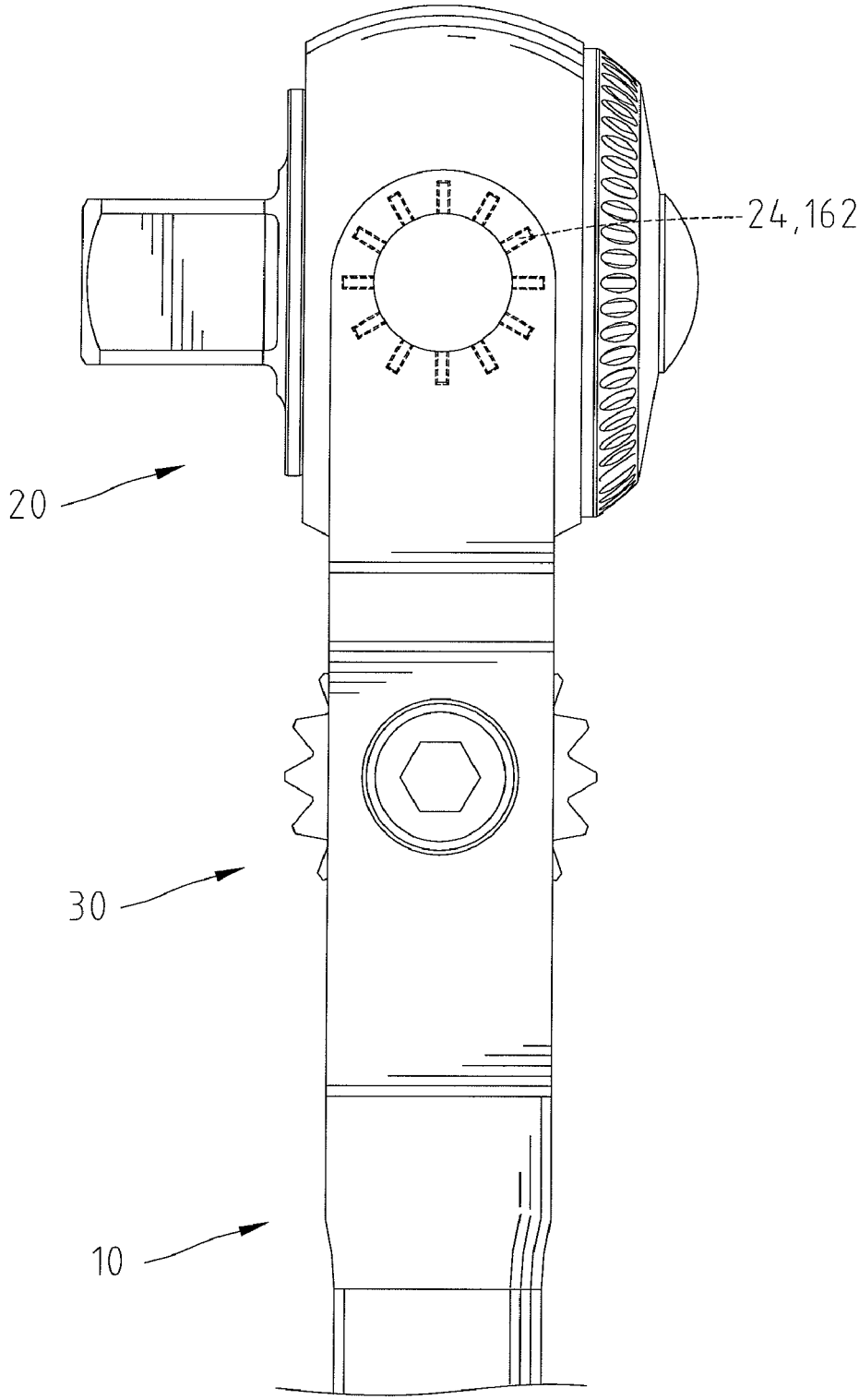
FIG. 5 shows a partial, side view of the rotary wrench of FIG. 1 with the handle aligned with the head.
Figure 6:
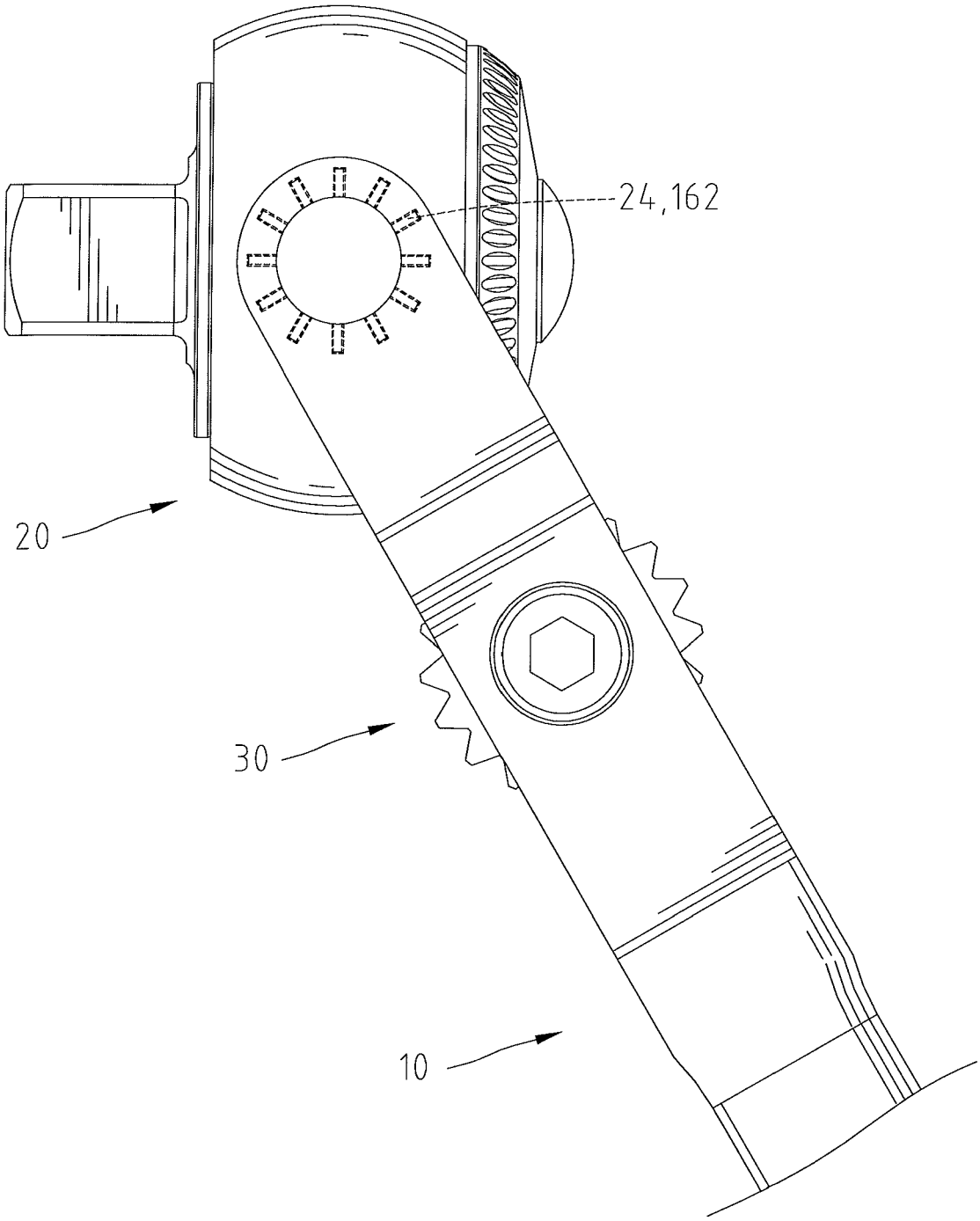
FIG. 6 shows a partial, side view of the rotary wrench of FIG. 1 with the handle at an acute angle with the head.

Now that the basic construction of the rotary wrench of the preferred teachings of the present invention has been explained, the operation and some of the advantages of the rotary wrench can be set forth and appreciated utilizing the embodiment shown in FIGS. 1-8. In particular, for the sake of explanation, it will be assumed that first and second arms 14 are initially in the releasing portion (FIGS. 3 and 4). Positioning portion 24 of head 20 is disengaged from positioning section 162 of holding portion 16. Specifically, ribs 25 on first side 28 of head 20 are disengaged from grooves 165 of holding portion 16 of first arm 14. Thus, head 20 is rotatable about second axis Y, allowing adjustment of an angle between longitudinal axis L of head 20 and first axis X (see FIGS. 5 and 6).

Figure 7:
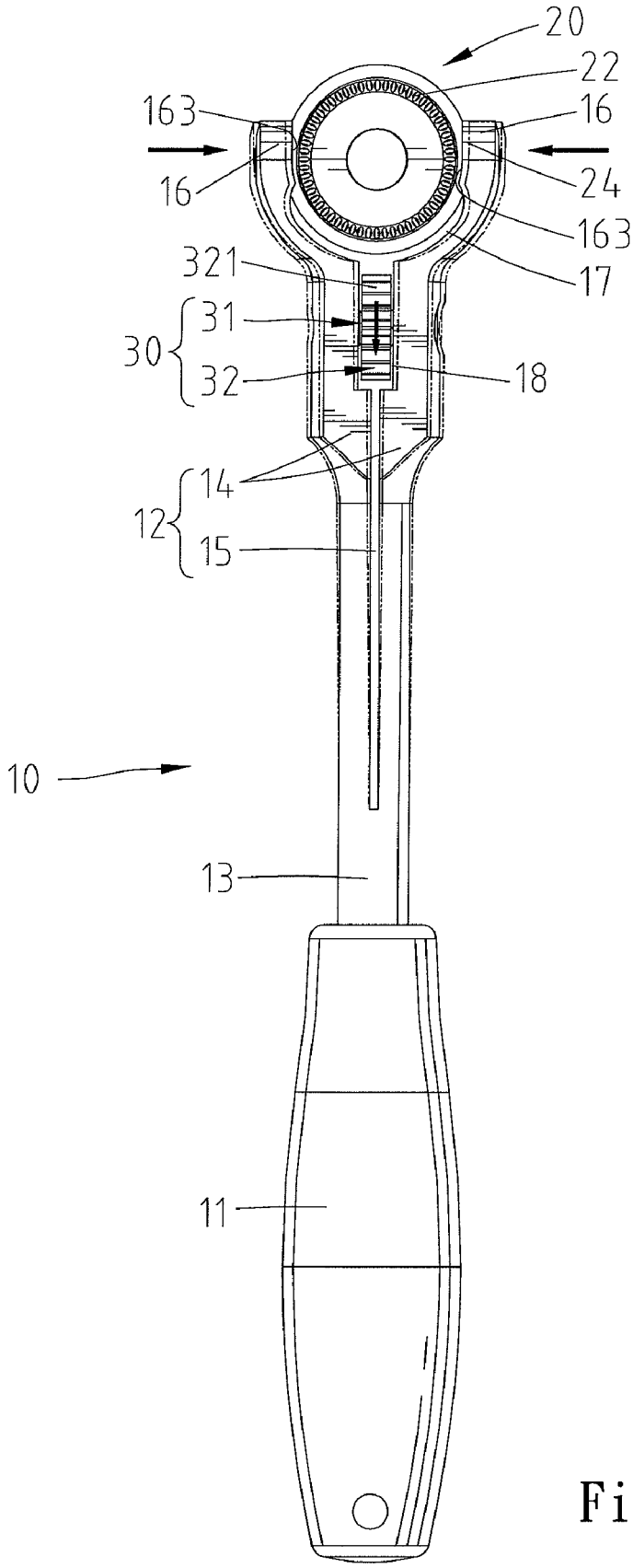
FIG. 7 shows adjustment of relative position between the arms of the handle of the rotary wrench of FIG. 1.
Figure 8:
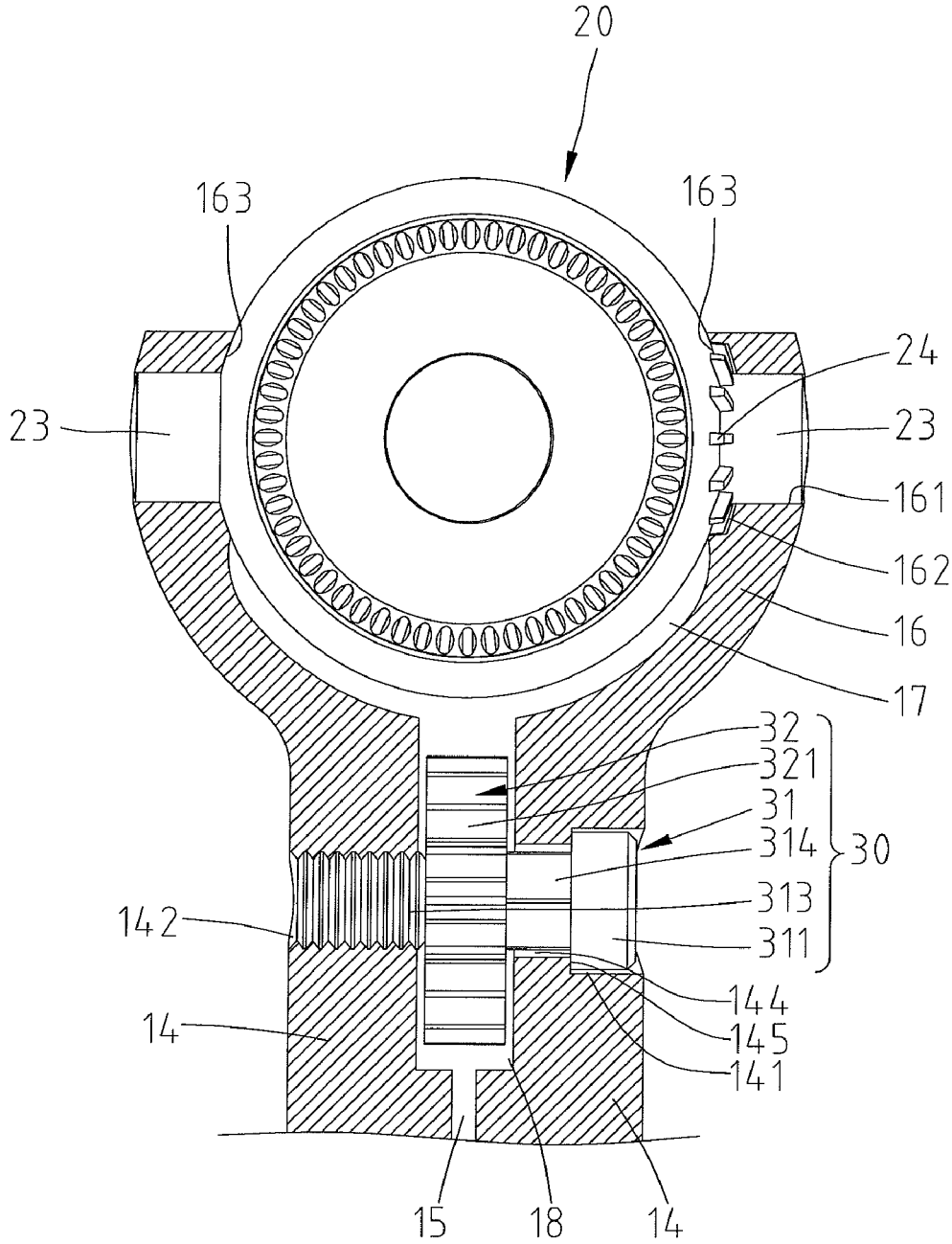
FIG. 8 shows a partial, cross sectional view of the rotary wrench of FIG. 1 with the arms of the handle engaged with the head to position the head relative to the handle.
Figure 9:
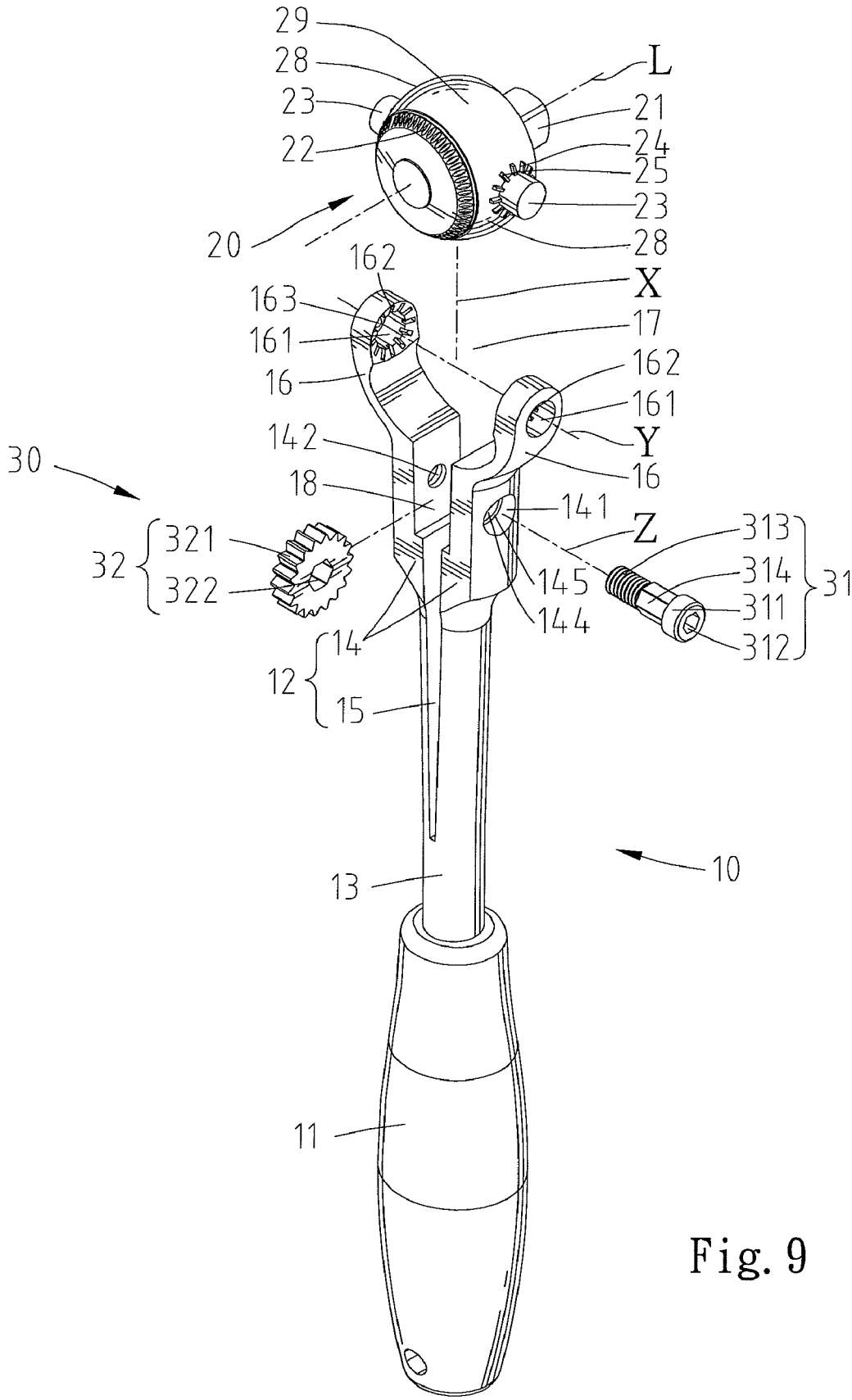
FIG. 9 shows an exploded, perspective view of a rotary wrench of another embodiment according to the preferred teachings of the present invention.
Figure 10:
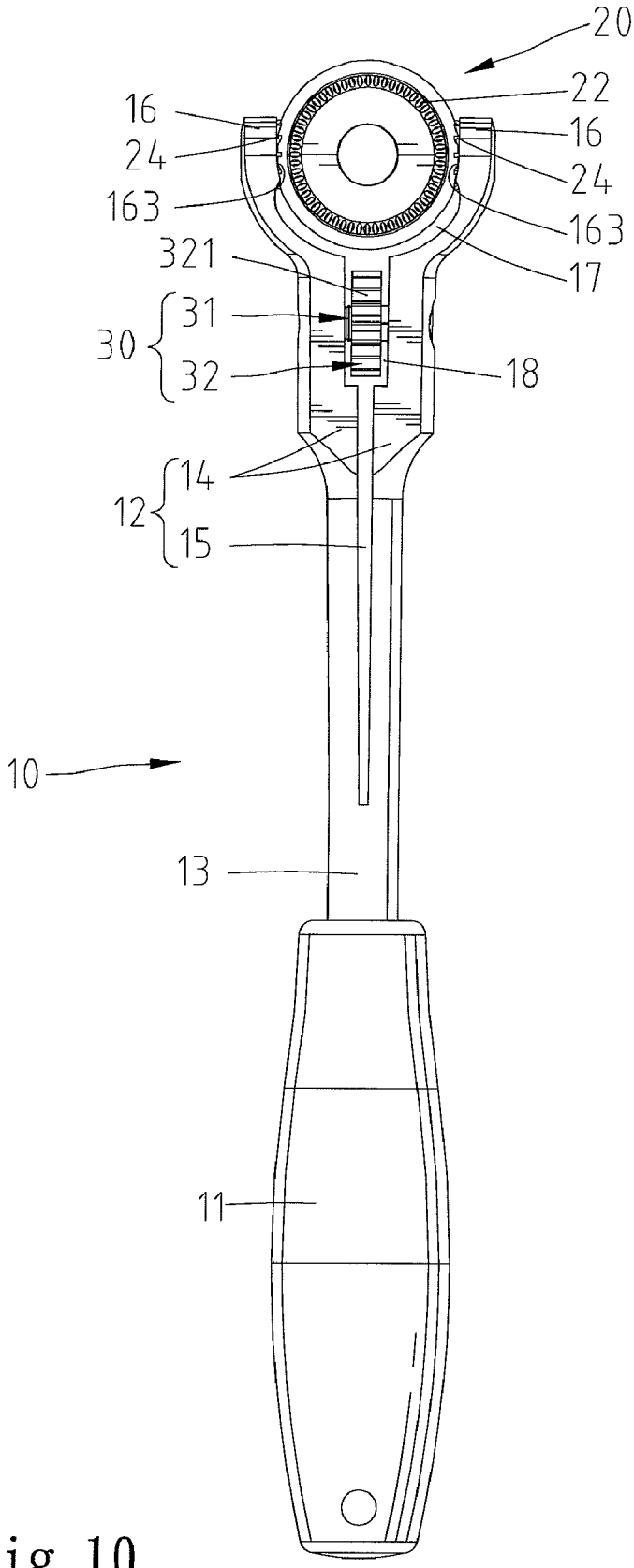
FIG. 10 shows a side view of the rotary wrench of FIG. 9.
Figure 11:
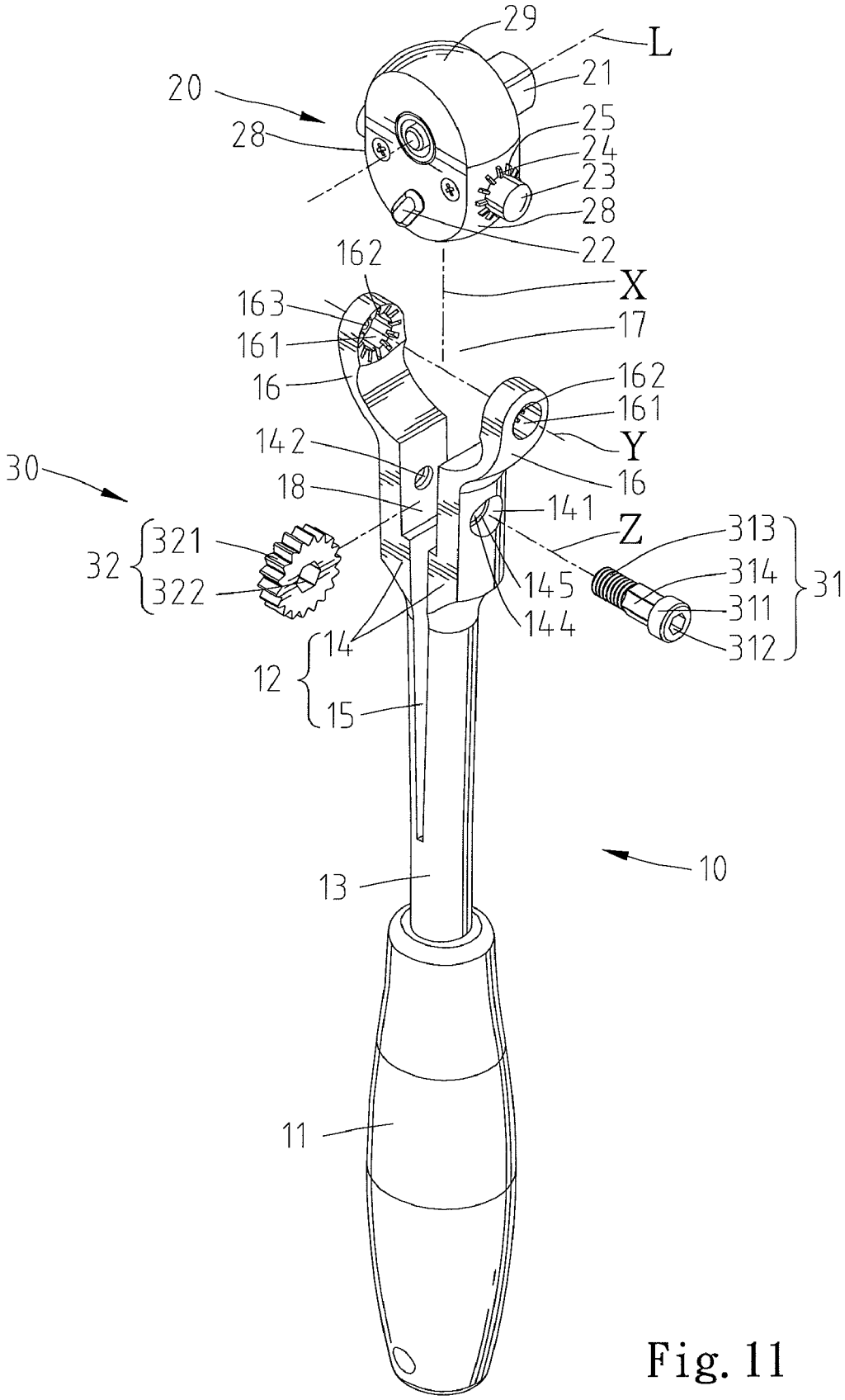
FIG. 11 shows an exploded, perspective view of a rotary wrench of a further embodiment according to the preferred teachings of the present invention.
Figure 12:
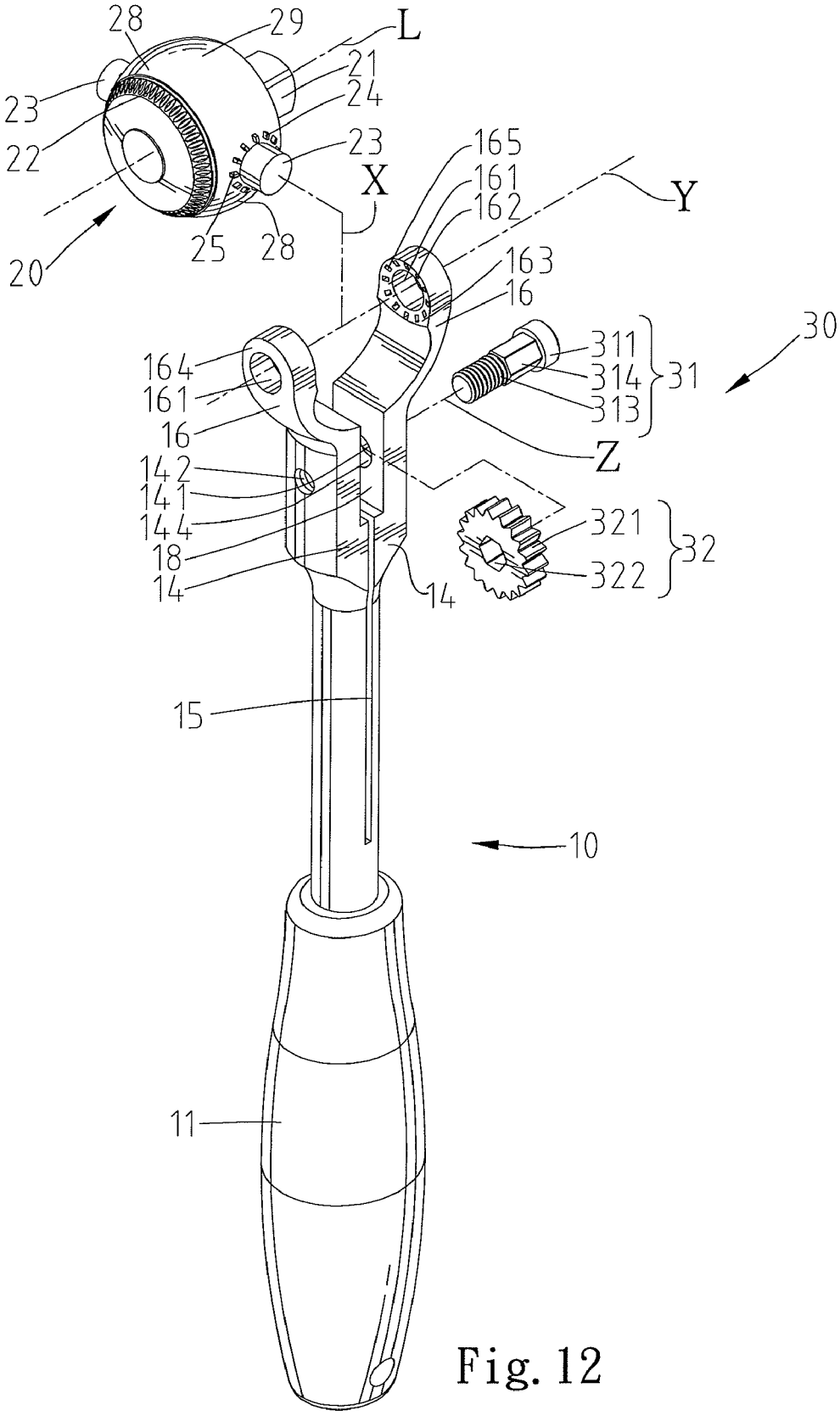
FIG. 12 shows an exploded, perspective view of a rotary wrench of still another embodiment according to the preferred teachings of the present invention.

First and second arms 14 can be moved to the clamping position by operating adjusting member 31 through adjusting wheel 32 or the tool (FIG. 7). When first and second arms 14 are in the clamping position (FIG. 8), positioning portion 24 of head 20 is engaged with positioning section 162 of holding portion 16. Specifically, ribs 25 on first side 28 of head 20 are engaged with grooves 165 of holding portion 16 of first arm 14. Thus, head 20 is retained in one of the angular positions so that head 20 is not rotatable about second axis Y, not allowing adjustment of the angle between longitudinal axis L of head 20 and first axis X. Note that head portion 311 of adjusting member 31 presses against shoulder 145 when first and second arms 14 are in the clamping position.

In the preferred form shown in FIGS. 9-12, when first and second arms 14 are in the releasing position, ribs 25 on both of first and second sides 28 of head 20 are disengaged from grooves 165 of holding portions 16 of first and second arms 14. Thus, head 20 is rotatable about second axis Y, allowing adjustment of the angle between longitudinal axis L of head 20 and first axis X. On the other hand, when first and second arms 14 are in the clamping position, ribs 25 on each of first and second sides 28 of head 20 are engaged with grooves 165 of holding portion 16 of one of first and second arms 14. Thus, head 20 is retained in one of the angular positions so that head 20 is not rotatable about second axis Y, not allowing adjustment of the angle between longitudinal axis L of head 20 and first axis X.

In the preferred form shown in FIGS. 13-14, when first and second arms 14 are in the releasing position, ribs 166 of holding portions 16 of both of first and second arms 14 are disengaged from grooves 26 on one of first and second sides 28 of head 20. Thus, head 20 is rotatable about the second axis, allowing adjustment of an angle between longitudinal axis L of head 20 and first axis X. On the other hand, when first and second arms 14 are in the clamping position, ribs 166 of holding portion 16 of each of first and second arms 14 are engaged with grooves 26 of one of first and second sides 28 of head 20. Thus, head 20 is retained in one of the angular positions so that head 20 is not rotatable about second axis Y, not allowing adjustment of the angle between longitudinal axis L of head 20 and first axis X.

Figure 15:
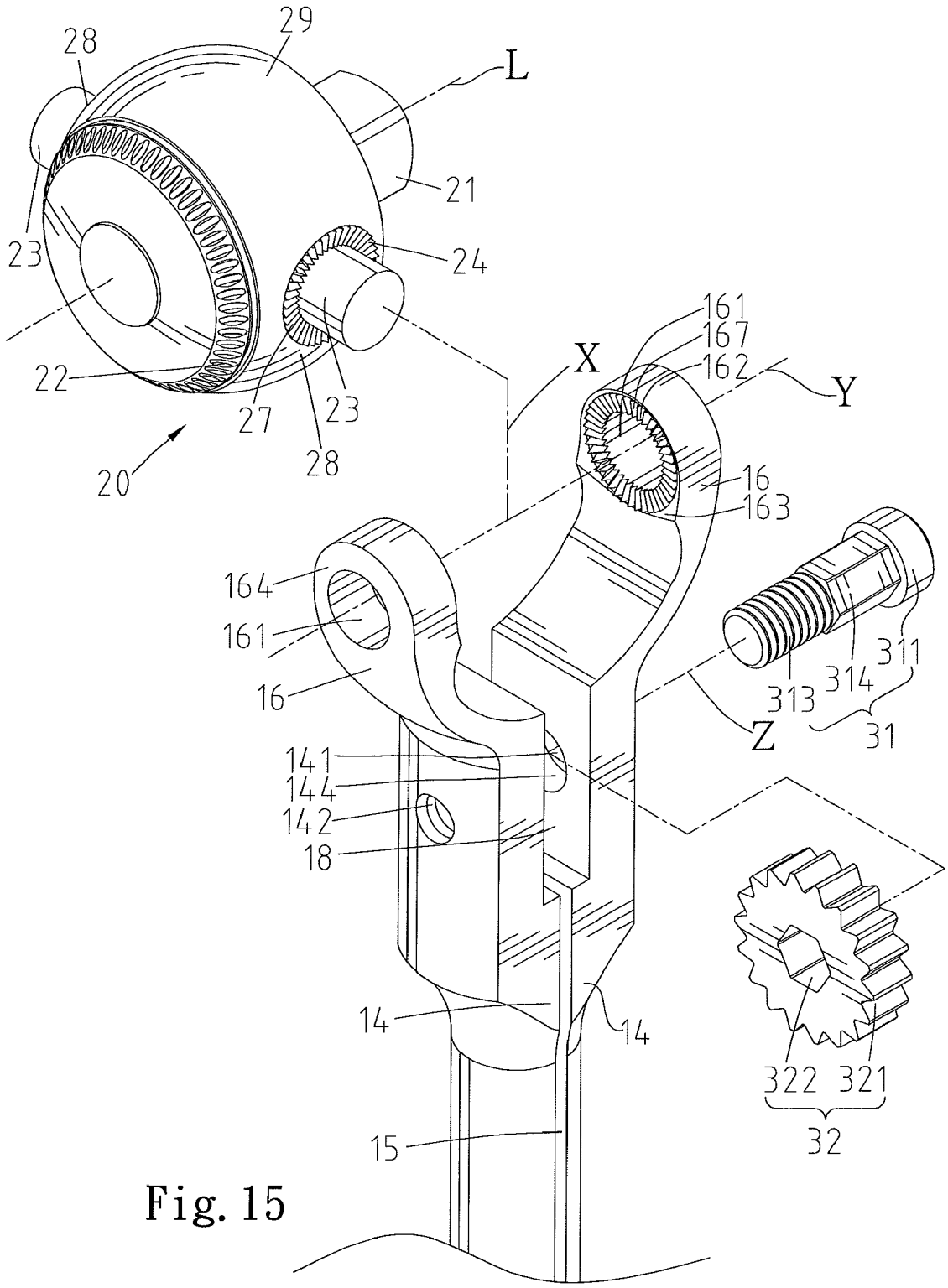
FIG. 15 shows a partial, exploded, perspective view of a rotary wrench of still another embodiment according to the preferred teachings of the present invention.

In the preferred form shown in FIG. 15, when first and second arms 14 are in the releasing position, teeth 167 of holding portions 16 of both of first and second arms 14 are disengaged from teeth 27 on first and second sides 28 of head 20. Thus, head 20 is rotatable about second axis Y, allowing adjustment of an angle between longitudinal axis L of head 20 and first axis X. On the other hand, when first and second arms 14 are in the clamping position, teeth 167 of holding portion 16 of each of first and second arms 14 are engaged with teeth 27 on one of first and second sides 28 of head 20. Thus, head 20 is retained in one of the angular positions so that head 20 is not rotatable about second axis Y, not allowing adjustment of the angle between longitudinal axis L of head 20 and first axis X.

Thus, the rotary wrenches according to the teachings of the present invention allow easy adjustment of an angular position of head 20 relative to handle 10 while providing reliable positioning effect to retain head 20 relative to handle 10 after adjustment. Furthermore, the rotary wrenches according to the teachings of the present invention are simple and, thus, can be easily manufactured and assembled at low costs.

Now that the basic teachings of the present invention have been explained, many extensions and variations will be obvious to one having ordinary skill in the art. For example, in the preferred forms shown in FIGS. 11-15, head 20 can include positioning portion 24 only on either first side 28 or second side 28, and positioning section 162 can only be formed on holding portion 16 of either first arm 14 or second arm 14. Furthermore, hole 142 does not have to be a screw hole, and adjusting member 31 could extend beyond hole 142 and engaged with a nut to provide the same adjusting function. However, other provisions for adjusting the spacing between first and second arms 14 can be utilized according to the teachings of the present invention. Furthermore, adjusting device 30 does not have to include adjusting wheel 32 when considering costs of manufacturing and assembling. First and second arms 14 do not have to include slit 15 when movement of first and second arms 14 between the clamping position and the releasing position is still allowed. In this case, first and second arms 14 do not have to extend to a position adjacent end 13.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A rotary wrench comprising, in combination:

a handle including a gripping portion and a clamping portion arranged along a first axis, with the clamping portion including first and second arms having a spacing along a second axis perpendicular to the first axis, with the first arm including a first holding portion having a first hole, with the second arm including a second holding portion having a second hole, with the first holding portion including a first positioning section;

a head including a longitudinal axis perpendicular to the second axis, with the head including first and second sides spaced along the second axis and on opposite sides of the longitudinal axis, with first and second axles respectively formed on the first and second sides, with the first and second axles rotatably engaged in the first and second holes, with the first side of the head including a first positioning portion releasably engagable with the first positioning section of the first holding portion so that the head is rotatable relative to the handle about the second axis and positionable relative to the second axis in one of a plurality of angular positions surrounding the second axis, with the handle being operable to rotate the head about the longitudinal axis for driving an object, with the first holding portion including an inner face facing the head, with the first holding portion further including an outer face spaced from the inner face along the second axis and facing away from the head, with the first positioning section formed on the inner face of the first holding portion, with the head including an outer periphery having the first and second sides, and with the first positioning portion formed on the first side of the outer periphery of the head; and an adjusting member mounted to the first and second arms, with the adjusting member operable to adjust the spacing between the first and second arms to move the first and second arms between a clamping position clamping the head and a releasing position not clamping the head;

wherein when the first and second arms are in the releasing position, the first positioning portion of the head is disengaged from the first positioning section of the first holding portion, the head is rotatable about the second axis, allowing adjustment of an angle between the longitudinal axis of the head and the first axis, and wherein when the first and second arms are in the clamping position, the first positioning portion of the head is engaged with the first positioning section of the first holding portion to retain the head in one of the plurality of angular positions, the head is not rotatable about the second axis, not allowing adjustment of the angle between the longitudinal axis of the head and the first axis.

2. The rotary wrench as claimed in claim 1, with the first positioning section including a plurality of grooves formed in the inner face of the first holding portion and spaced from one another in a circumferential direction about the second axis, with the first positioning portion including a plurality of ribs formed on the first side of the head and spaced from one another in the circumferential direction about the first axle, with the plurality of ribs disengaged from the plurality of grooves when the first and second arms are in the releasing position, and with the plurality of ribs engaged with the plurality of grooves when the first and second arms are in the clamping position.

3. The rotary wrench as claimed in claim 2, with each of the plurality of grooves being in communication with the first hole and extending towards but spaced from the outer face of the first positioning portion, with each of the plurality of ribs extending from the outer periphery of the head to an outer periphery of the first axle.

4. The rotary wrench as claimed in claim 2, with each of the plurality of grooves extending towards but spaced from the outer face of the first positioning portion, with each of the plurality of the grooves spaced from the first hole in a radial direction orthogonal to the second axis, and with each of the plurality of ribs spaced from an outer periphery of the first axle in the radial direction.

5. The rotary wrench as claimed in claim 1, with the first positioning section including a plurality of ribs formed on the inner face of the first holding portion and spaced from one another in a circumferential direction about the second axis, with the first positioning portion including a plurality of grooves formed in the first side of the head and spaced from one another in the circumferential direction about the first axle, with the plurality of ribs disengaged from the plurality of grooves when the first and second arms are in the releasing position, and with the plurality of ribs engaged with the plurality of grooves when the first and second arms are in the clamping position.

6. The rotary wrench as claimed in claim 1, with the with the first positioning section including a plurality of first teeth formed on the inner face of the first holding portion and arranged in a circumferential direction about the second axis, with the first positioning portion including a plurality of second teeth formed on the first side of the head and arranged in the circumferential direction about the first axle, with the plurality of first teeth disengaged from the plurality of second teeth when the first and second arms are in the releasing position, and with the plurality of first teeth engaged with the plurality of second teeth when the first and second arms are in the clamping position.

7. A rotary wrench comprising, in combination:

a handle including a gripping portion and a clamping portion arranged along a first axis, with the clamping portion including first and second arms having a spacing along a second axis perpendicular to the first axis, with the first arm including a first holding portion having a first hole, with the second arm including a second holding portion having a second hole, with the first holding portion including a first positioning section;

a head including a longitudinal axis perpendicular to the second axis, with the head including first and second sides spaced along the second axis and on opposite sides of the longitudinal axis, with first and second axles respectively formed on the first and second sides, with the first and second axles rotatable engaged in the first and second holes, with the first side of the head including a first positioning portion releasably engagable with the first positioning section of the first holding portion so that the head is rotatable relative to the handle about the second axis and positionable relative to the second axis in one of a plurality of angular positions surrounding the second axis, with the handle being operable to rotate the head about the longitudinal axis for driving an object; and an adjusting member mounted to the first and second arms, with the adjusting member operable to adjust the spacing between the first and second arms to move the first and second arms between a clamping position clamping the head and a releasing position not clamping the head, with the adjusting member including a threaded section, with the first arm including a third hole extending along a third axis parallel to and spaced from the second axis along the first axis, with the third axis having a spacing to the gripping portion smaller than a spacing from second axis to the gripping portion along the first axis, with the second arm including a fourth hole extending along the third axis, with one of the first and second holes being a screw hole, with the adjusting member extending through the third and fourth holes, with the threaded section of the adjusting member threadedly engaged with the screw hole, and with the adjusting member being rotatable about the third axis to adjust the spacing between the first and second arms so as to move the first and second arms between the releasing position and the clamping position;

wherein when the first and second arms are in the releasing position, the first positioning portion of the head is disengaged from the first positioning section of the first holding portion, the head is rotatable about the second axis, allowing adjustment of an angle between the longitudinal axis of the head and the first axis, and wherein when the first and second arms are in the clamping position, the first positioning portion of the head is engaged with the first positioning section of the first holding portion to retain the head in one of the plurality of angular positions, the head is not rotatable about the second axis, not allowing adjustment of the angle between the longitudinal axis of the head and the first axis.

8. The rotary wrench as claimed in claim 7, with the adjusting member including a head portion, the threaded section, and an intermediate portion intermediate the head portion and the threaded section, with another of the third and fourth holes including a reduced section having a diameter smaller than a remaining portion of the other of the third and fourth holes, forming a shoulder, with the intermediate portion extending through the other of the third and fourth holes, with the head portion received in the other of the third and fourth holes and having a diameter larger than that of the reduced section.

9. The rotary wrench as claimed in claim 8, with the head portion of the adjusting member including a groove adapted to engage with a tool for driving the adjusting member to rotate about the third axis, and with the head portion pressing against the shoulder when the first and second arms are in the clamping position.

10. The rotary wrench as claimed in claim 8, further comprising, in combination: an adjusting wheel securely mounted around the intermediate portion to rotate therewith about the third axis, with the adjusting wheel including an outer periphery adapted to be manually rotated to rotate the adjusting member about the third axis, and with the head portion pressing against the shoulder when the first and second arms are in the clamping position.

11. The rotary wrench as claimed in claim 10, with the spacing between the first and second holding portions of the first and second arms defining a holding space rotatably receiving the head, with a slit formed between the first and second arms, with the slit intermediate the third axis and the gripping portion along the first axis, with a compartment formed between the first and second arms and in communication with the holding space and the slit, with the compartment intermediate the holding space and the slit along the first axis, and with the adjusting wheel rotatably received in the compartment.

12. The rotary wrench as claimed in claim 11, with the intermediate portion of the adjusting member having non-circular cross sections, with the adjusting wheel including a through-hole having non-circular cross sections corresponding to the intermediate portion of the adjusting member, with the intermediate portion of the adjusting member extending through the through-hole, and with the slit having deceasing widths toward the gripping portion along the first axis.

13. The rotary wrench as claimed in claim 11, with the second holding portion including a second positioning section spaced from the first positioning section along the second axis, with the second side of the head including a second positioning portion spaced from the first positioning portion along the second axis, wherein when the first and second arms are in the releasing position, the second positioning portion of the head is disengaged from the second positioning section of the second holding portion, the head is rotatable about the second axis, allowing adjustment of the angle between the longitudinal axis of the head and the first axis, and wherein when the first and second arms are in the clamping position, the second positioning portion of the head is engaged with the second positioning section of the second holding portion to retain the head in one of the plurality of angular positions, the head is not rotatable about the second axis, not allowing adjustment of the angle between the longitudinal axis of the head and the first axis.

14. A rotary wrench comprising, in combination:

a handle including a gripping portion and a clamping portion arranged along a first axis, with the clamping portion including first and second arms having a spacing along a second axis perpendicular to the first axis, with the first arm including a first holding portion having a first hole, with the second arm including a second holding portion having a second hole, with the first holding portion including a first positioning section, with the second holding portion including a second positioning section spaced from the first positioning section along the second axis;

a head including a longitudinal axis perpendicular to the second axis, with the head including first and second sides spaced along the second axis and on opposite sides of the longitudinal axis, with first and second axles respectively formed on the first and second sides, with the first and second axles rotatably engaged in the first and second holes, with the first side of the head including a first positioning portion releasably engagable with the first positioning section of the first holding portion so that the head is rotatable relative to the handle about the second axis and positionable relative to the second axis in one of a plurality of angular positions surrounding the second axis, with the handle being operable to rotate the head about the longitudinal axis for driving an object, with the second side of the head including a second positioning portion spaced from the first positioning portion along the second axis; and an adjusting member mounted to the first and second arms, with the adjusting member operable to adjust the spacing between the first and second arms to move the first and second arms between a clamping position clamping the head and a releasing position not clamping the head;

wherein when the first and second arms are in the releasing position, the first positioning portion of the head is disengaged from the first positioning section of the first holding portion, the head is rotatable about the second axis, allowing adjustment of an angle between the longitudinal axis of the head and the first axis;

wherein when the first and second arms are in the releasing position, the second positioning portion of the head is disengaged from the second positioning section of the second holding portion, the head is rotatable about the second axis, allowing adjustment of the angle between the longitudinal axis of the head and the first axis;

wherein when the first and second arms are in the clamping position, the first positioning portion of the head is engaged with the first positioning section of the first holding portion to retain the head in one of the plurality of angular positions, the head is not rotatable about the second axis, not allowing adjustment of the angle between the longitudinal axis of the head and the first axis; and wherein when the first and second arms are in the clamping position, the second positioning portion of the head is engaged with the second positioning section of the second holding portion to retain the head in one of the plurality of angular positions, the head is not rotatable about the second axis, not allowing adjustment of the angle between the longitudinal axis of the head and the first axis.

15. The rotary wrench as claimed in claim 14, with the second holding portion including an inner face facing the head, with the second holding portion further including an outer face spaced from the inner face along the second axis and facing away from the head, with the second positioning section formed on the inner face of the second holding portion, with the head including an outer periphery having the first and second sides, and with the second positioning portion formed on the second side of the outer periphery of the head.

16. The rotary wrench as claimed in claim 15, with the second positioning section including a plurality of grooves formed in the inner face of the second holding portion and spaced from one another in a circumferential direction about the second axis, with the second positioning portion including a plurality of ribs formed on the second side of the head and spaced from one another in the circumferential direction about the second axle, with the plurality of ribs disengaged from the plurality of grooves when the first and second arms are in the releasing position, and with the plurality of ribs engaged with the plurality of grooves when the first and second arms are in the clamping position.

17. The rotary wrench as claimed in claim 16, with each of the plurality of grooves being in communication with the second hole and extending towards but spaced from the outer face of the second positioning portion, with each of the plurality of ribs extending from the outer periphery of the head to an outer periphery of the second axle.

18. The rotary wrench as claimed in claim 15, with the second positioning section including a plurality of ribs formed on the inner face of the second holding portion and spaced from one another in a circumferential direction about the second axis, with the second positioning portion including a plurality of grooves formed in the second side of the head and spaced from one another in the circumferential direction about the second axle, with the plurality of ribs disengaged from the plurality of grooves when the first and second arms are in the releasing position, and with the plurality of ribs engaged with the plurality of grooves when the first and second arms are in the clamping position.

19. The rotary wrench as claimed in claim 15, with the second positioning section including a plurality of first teeth formed on the inner face of the second holding portion and arranged in a circumferential direction about the second axis, with the second positioning portion including a plurality of second teeth formed on the second side of the head and arranged in the circumferential direction about the second axle, with the plurality of first teeth disengaged from the plurality of second teeth when the first and second arms are in the releasing position, and with the plurality of first teeth engaged with the plurality of second teeth when the first and second arms are in the clamping position.

* * * * *